US005435153A

United States Patent [19]

Hutchison et al.

[11] Patent Number: 5,435,153

[45] Date of Patent: Jul. 25, 1995

[54] RECEIVER/DRIER

[75] Inventors: Wayne K. Hutchison, Ingersoll; William N. Eybergen, Dutton, both of Canada

[73] Assignee: Eaton Corporation, Cleveland, Ohio

[21] Appl. No.: 214,718

[22] Filed: Mar. 16, 1994

[51] Int. Cl.[6] ..... F25B 43/00

[52] U.S. Cl. ..... 62/474; 62/509; 210/455; 210/DIG. 6; 29/163.8; 29/890.06

[58] Field of Search ..... 62/503, 509, 474; 210/455, DIG. 6; 29/163.8, 422, 890.06

[56] References Cited

U.S. PATENT DOCUMENTS

| | | | |
|---|---|---|---|
| 2,646,678 | 7/1953 | Standing et al. | 210/455 |
| 3,545,227 | 12/1970 | Grahl | 62/474 |
| 4,009,715 | 3/1977 | Forberg et al. | 210/455 X |
| 4,331,001 | 5/1982 | Jones | 62/503 |
| 4,707,999 | 11/1987 | Otha et al. | 62/474 |
| 4,756,166 | 7/1988 | Tomasov | 62/509 |
| 4,934,552 | 6/1990 | Koide et al. | 62/509 X |
| 5,038,582 | 8/1991 | Takamatsu | 62/474 |
| 5,179,780 | 1/1993 | Wintersteen et al. | 29/422 X |
| 5,289,697 | 3/1994 | Hutchison | 62/474 |

*Primary Examiner*—Harry B. Tanner
*Attorney, Agent, or Firm*—Roger A. Johnston

[57] ABSTRACT

A receiver/drier for fluid refrigerant having the housing formed of an aluminum header with a centrally disposed outlet port and off-center inlet port welded to an aluminum canister. A header sub-assembly is formed with an outlet tube with one attached to the header outlet port. A basket with a perforated bottom is filled with desiccant and the open end is attached to the header with the outlet tube ending through an aperture in the bottom of the basket. A layer of filter material is disposed adjacent the perforated bottom of the basket, the inner face of the header has plural concentric grooves interconnecting the inlet port and another layer of filter material disposed adjacent the grooved face of the header; and these grooves distribute flow over the filter in the event of contaminant accumulations in the inlet. The basket is attached to the header to complete the header sub-assembly prior to welding of the header to the aluminum canister.

17 Claims, 1 Drawing Sheet

RECEIVER/DRIER

BACKGROUND OF THE INVENTION

The present invention relates to receiver/driers for fluid refrigerant circulated in refrigeration and air conditioning systems. The invention relates particularly for receiver/driers utilized in vehicle passenger compartment air conditioning systems and particularly those utilized for high volume mass production of such systems. In providing receiver/driers for high volume production of vehicle air conditioning systems, it is desired to provide lightweight and also low manufacturing cost particularly in highly competitive applications situations such as air conditioning systems for passenger cars and light trucks.

Heretofore, receiver/driers for high volume production vehicle air conditioning systems have been fabricated with canisters having a metal basket insert containing granular desiccant material with the basket covered with a perforated cover. Alternatively, the desiccant material has been prepackaged in bags, but this approach has proven to be troublesome during assembly of the receiver/drier.

In fabricating receiver/driers where the granular desiccant is disposed in a metal basket, accurate positioning of the basket cover has been required in order to provide proper communication with the inlet of the receiver/drier typically located on the canister top or header to prevent clogging and reduced flow through the receiver/drier. This latter type of construction requires accurate positioning of the basket and basket cover and has also proven to be troublesome in assembly and has resulted in increased manufacturing costs. Thus it has been desired to provide a receiver/drier for fluid refrigerant which is low in manufacturing cost, lightweight and easy to assembly in high volume mass production.

Referring to FIG. 3, a typical prior art receiver/drier for a passenger car air conditioning system is shown indicated generally at 10 wherein a header 12 is welded to the upper end of a canister 13. The header 12 has an inlet port 14 and an outlet port 16 provided therein with an elongated tube 18 attached to the inlet port 14 and which extends downwardly from the header. A metal desiccant basket 20 has granular desiccant material 22 therein which has the tube 18 passing downwardly therethrough and a layer of filter material 24 covers the desiccant and is in turn covered by a perforated cover plate 26. The upper rim of the basket is crimped over a reduced diameter portion 30 of the header to retain the basket in place. A plenum chamber or space 32 is provided above the perforated plate or cover 26 to ensure flow through the desiccant material.

SUMMARY OF THE INVENTION

The present invention provides a unique construction for a receiver/drier for fluid refrigerant which provides for fluid flow through the desiccant material in the event the inlet port is plugged and provides for reduced number of parts and lowered manufacturing costs. The receiver/drier of the present invention employs a cover or header plate for the canister or housing with an inlet and outlet port formed in the header and an elongated tube attached to the outlet port and extending into the canister. The interior face of the header is grooved such that the grooves communicate with the inlet port. A metal basket having the bottom perforated has the open end attached over the header and is filled with desiccant with a layer of filter material disposed in the bottom over the perforations and another layer of filter material disposed over the desiccant material and adjacent the grooved portions of the header. The canister is then assembled over the header sub-assembly and welded to the header plate.

DETAILED DESCRIPTION

Figure 2:
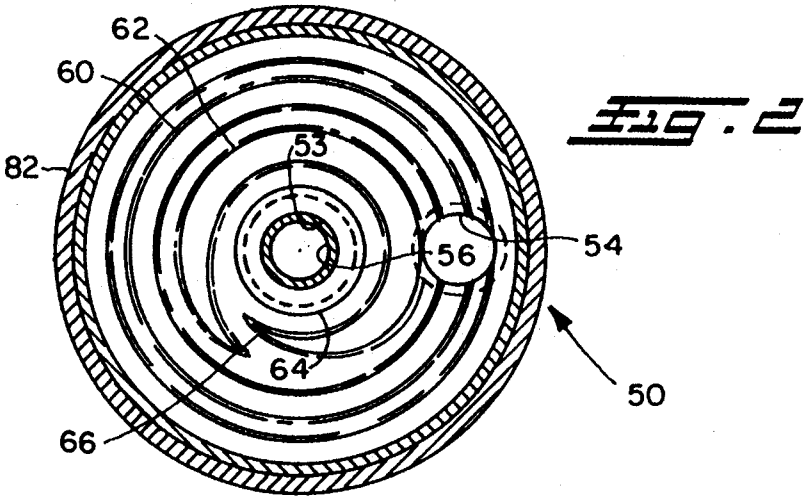
FIG. 2 is a section view taken along section indicating lines 2—2 of FIG. 1; and, FIG. 3 is a portion of a section view similar to FIG. 1 illustrating the prior art.
Figure 3:
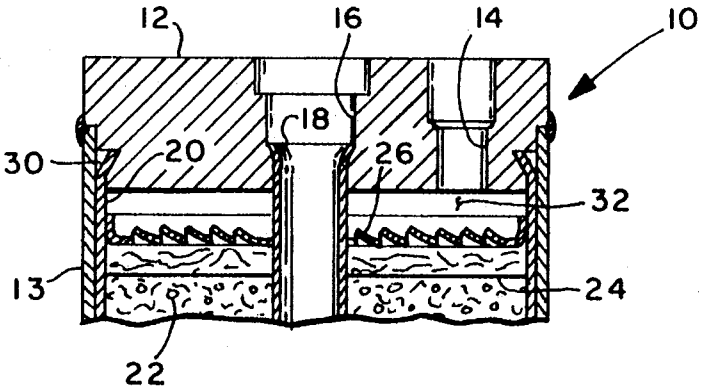
FIG. 3 PRIOR ART
Figure 1:
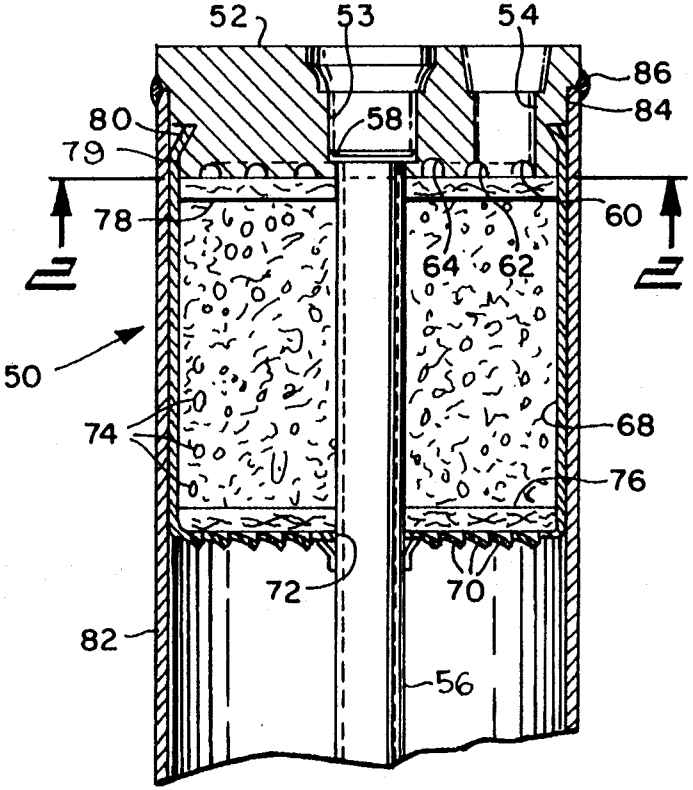
FIG. 1 is a cross-section of the assembled receiver/drier of the present invention.

Referring to FIGS. 1 and 2, the receiver/drier assembly of the present invention is indicated generally at 50 and includes a header member or plate 52 having a generally circular configuration and having an inlet port 54 formed therethrough and a preferably centrally located outlet port 53 formed therethrough. Outlet port 53 has securely attached thereto, preferably by flaring, one end of an elongated tube 56; and, the flared portion is indicated by reference numeral 58 in FIG. 1.

The under surface of header 52 has formed therein at least one and preferably a plurality of recesses or grooves having a circular configuration in plan view and denoted by reference numerals 60,62,64. Referring to FIG. 2, the innermost groove 64 and the adjacent middle groove 62 are interconnected by a radially extending passage or groove 66.

It will be observed from FIG. 2 that outer groove 60 and middle groove 62 intersect the inlet port 54 and are in continuous communication therewith.

A generally cup shaped cylindrical desiccant basket 68 has the closed end or bottom thereof perforated as denoted by reference numeral 70 in a plurality of perforations and has a central aperture 72 formed therein. The basket is filled with desiccant material preferably of the granular variety indicated by reference numeral 74. A layer of filter material preferably fibrous glass material is provided adjacent the perforations 70 on the inner surface of the basket. A second layer of filter material 78 is provided over the desiccant fill; and, the basket is received over the tube 56 which extends downwardly through the aperture 72.

The upper end of the basket is received over a reduced diameter portion 79 of the header; and, the rim of the basket is deformed or crimped about the reduced diameter portion 79 as denoted by reference numeral 80 in FIG. 1 to secure the basket to the header. The filter layer 79 is disposed adjacent the grooves 60,62,64,66 and fluid entering port 54 is thus distributed over the surface of the filter 78. This arrangement provides for continued flow over a large area of the filter material in the event that the region around the inlet port becomes clogged from debris or foreign material at the surface of the filter.

The assembly of the basket, filters, desiccant and tube 56 thus form a sub-assembly with the header 52. Upon completion of the header sub-assembly, an outer canister 82 is received over the sub-assembly and the open end thereof is registered on a second reduced diameter portion 84 of the header. The upper or open end of the canister 82 is secured and sealed on the diameter 84 by peripheral weldment indicated by reference numeral 86 in FIG. 1. It will be understood that the header and tube 56 and outer canister 82 are formed of aluminum. If desired the basket may also be formed of aluminum.

The present invention thus provides a unique and novel low cost lightweight assembly for a receiver/drier for fluid refrigerant. The construction of the invention provides for ensuring adequate flow of refrigerant therethrough in the event of accumulation of contaminants at the inlet; and, the construction achieves this purpose with a minimum of parts and ease of assembly.

Although the invention has hereinabove been described with respect to the illustrated embodiment, it will be understood that the invention is capable of modification and variation and is limited only by the following claims.

We claim:

1. A receiver/drier for fluid refrigerant comprising:

(a) canister means having one end open;

(b) a header sub-assembly including (i) a header member having plural spaced fluid ports therethrough with at least one recess or groove interconnecting one of said ports on a common side of said header member;

(ii) a desiccant basket having one open end thereof attached to said header and the closed end thereof perforated;

(iii) filter means disposed adjacent said perforated end and said grooved side of said header member;

(iv) desiccant material disposed in said basket;

(v) an elongated outlet tube having one end secured to another of said header ports and the other end passing through said desiccant and said perforated closed end of said basket; and, (c) said header member attached to said open end of said canister.

2. The receiver/drier defined in claim 1, wherein said canister is secured to said header member by weldment.

3. The receiver/drier defined in claim 1, wherein said outlet tube is centrally located in said header member and basket.

4. The receiver/drier defined in claim 1, wherein said at least one groove comprises a pair of concentric grooves and an interconnecting groove.

5. The receiver/drier defined in claim 1, wherein said filter material comprises fibrous glass wool material.

6. A receiver/drier for fluid refrigerant comprising:

(a) a canister having one end open;

(b) a header having spaced inlet and outlet fluid ports therethrough, and secured to and sealed about the open end of said canister, said header having at least one groove or recess formed on the side thereof interior to said canister, said groove intersecting said inlet fluid ports;

(c) a layer of filter material disposed over said inlet port and said groove; and, (d) desiccant material disposed in said canister adjacent said layer of filter material.

7. The receiver/drier defined in claim 6, wherein said desiccant is received in a basket attached to said header.

8. The receiver/drier defined in claim 6, wherein said desiccant is in granular form.

9. The receiver/drier defined in claim 6, wherein said at least one groove comprises a plurality of concentric grooves with an interconnecting groove.

10. The receiver/drier defined in claim 6, wherein said outlet port is centrally located on said header.

11. The receiver/drier defined in claim 6, wherein said outlet port has a tube attached thereto and extending through said desiccant.

12. A header sub-assembly for a fluid refrigerant receiver/drier comprising:

(a) A header member having an inlet port and outlet port therethrough with at least one groove or recess formed on one side of said member and intersecting said inlet port;

(b) an elongated outlet tube attached to said outlet port and extending from said one side of said header member;

(c) a basket having the bottom thereof perforated and with an aperture therein with desiccant material disposed therein, said basket having the open end thereof attached to said header on said one side with said elongated tube extending through said aperture.

13. The sub-assembly defined in claim 12, wherein said basket has a first layer of filter material disposed therein adjacent said perforated bottom and a second layer of filter material disposed adjacent said one side of said header member.

14. A method of making a receiver/drier for fluid refrigerant comprising:

(a) providing a header member with an inlet and an outlet port therethrough;

(b) grooving one side of said member to intersect said inlet port;

(c) attaching an outlet tube to said outlet port;

(d) providing an open basket and perforating the bottom of said basket and forming an aperture therein;

(e) filling said basket with desiccant and assembling said aperture over said tube and attaching the open portion of said basket over said one side of said header member; and, attaching and sealing a canister over said basket and tube.

15. The method defined in claim 14, wherein said filling includes disposing a layer of filter material adjacent said perforated bottom and disposing another layer of filter material over said inlet port and grooving.

16. The method defined in claim 14, wherein said attaching and sealing comprises welding.

17. The method defined in claim 14, wherein said attaching said basket includes crimping the rim of said basket.

* * * * *